US005870015A

United States Patent [19]

Hinkel

[11] Patent Number: 5,870,015

[45] Date of Patent: Feb. 9, 1999

[54] METHOD AND APPARATUS FOR INSTRUCTION IN TOILET USE AND HYGIENE

[76] Inventor: Scott E. Hinkel, 4002 N. 22nd St., Tacoma, Wash. 98406

[21] Appl. No.: 818,251

[22] Filed: Mar. 14, 1997

[51] Int. Cl.[6] ..... G08B 23/00

[52] U.S. Cl. ..... 340/573; 340/603; 4/661

[58] Field of Search ..... 340/573, 603; 4/661; 128/886

[56] References Cited

U.S. PATENT DOCUMENTS

| | | | |
|---|---|---|---|
| D. 317,135 | 5/1991 | Novack | D10/104 |
| D. 357,201 | 4/1995 | Novack | D10/104 |
| 3,715,549 | 2/1973 | Kraff | 200/172 A |
| 4,366,873 | 1/1983 | Levy et al. | 177/25 |
| 4,733,419 | 3/1988 | Nee | 4/661 |
| 4,849,742 | 7/1989 | Warrington | 340/686 |
| 4,887,322 | 12/1989 | Lydon | 4/251 |
| 4,896,144 | 1/1990 | Bogstad | 340/691 |
| 4,979,238 | 12/1990 | Clark | 4/251 |
| 5,008,964 | 4/1991 | Dean et al. | 4/661 |
| 5,060,318 | 10/1991 | Jaskiewicz | 4/251 |
| 5,074,317 | 12/1991 | Bondell et al. | 128/886 |
| 5,276,595 | 1/1994 | Patrie | 362/101 |
| 5,279,000 | 1/1994 | Mercier et al. | 4/240 |
| 5,384,917 | 1/1995 | Epling | 4/235 |
| 5,577,915 | 11/1996 | Feldman | 434/238 |
| 5,748,096 | 5/1998 | Kaufer | 340/686 |

*Primary Examiner*—Jeffery A. Hofsass
*Assistant Examiner*—Ashok Mannava
*Attorney, Agent, or Firm*—Seed and Berry LLP

[57] ABSTRACT

A toilet instruction method and apparatus is described in which toilet use is monitored and one or more audible messages is produced which instruct users of the toilet regarding next steps in toilet use and hygiene. The apparatus includes a housing which is removably attachable to the toilet. A switch arm extends from the housing and is coupled with the toilet flush handle. An audio speaker is partly enclosed within the housing and produces the audible messages. Electronic circuitry enclosed within the housing receives a switch activity signal indicative of the position of the switch arm and responsively activates production of the audible messages. The electronic circuitry includes a message storage unit for storing a plurality of messages.

14 Claims, 2 Drawing Sheets

METHOD AND APPARATUS FOR INSTRUCTION IN TOILET USE AND HYGIENE

TECHNICAL FIELD

This invention relates generally to equipment for use with toilets, and more particularly, to equipment which monitors toilet use.

BACKGROUND OF THE INVENTION

Learning about toilet use and hygiene is an important stage in a child's development. Adults assist the child to learn the various steps involved, including lowering the toilet seat and lid, flushing the toilet, and properly washing hands following completed use of the toilet. Typically, children enjoy and have no difficulty learning to regularly flush the toilet. However, lowering the seat lid and properly washing hands is oftentimes the subject of repeated reminders.

Apparently, a number of adults (particularly men) never successfully complete their training in properly using the toilet. Given the frequency of letters to advice columnists on this subject, a significant number of grown men fail to complete one or more of the steps necessary to properly use the toilet. A number of attempts have been made to address the particular problem of properly lowering the toilet seat and lid. Devices have been constructed which automatically lower the toilet seat and/or lid. Other devices include lighted reminders to lower the toilet seat, or which set off an alarm in the event the toilet seat and/or lid is not lowered. In spite of the existence of such devices, a continued need exists for a method and apparatus which more effectively facilitates the various steps included in proper toilet use and hygiene.

SUMMARY OF THE INVENTION

According to the present invention, a method and apparatus is provided for instructing a person in the use of a toilet and associated personal hygiene. In one embodiment, a detector unit is adapted to monitor toilet use activity and to produce a detect signal upon detecting such activity. A control unit receives the detect signal and produces a control signal in response thereto. A message storage unit receives the control signal and responsively produces a message signal. A message output unit receives the message signal and produces a corresponding audible message instructing the person on appropriate next steps in toilet use and hygiene. The message storage unit may produce a plurality of message signals, each corresponding with a respective one of a plurality of recorded messages stored in the message storage unit. Selected ones of these messages are then provided to the person in response to detecting toilet use activity.

The apparatus may include a housing which is attachable to the toilet. A switch arm extending from the housing is adapted to couple with the toilet flushing mechanism. An audio speaker is partly enclosed within the housing and produces the audible message. Electronic circuitry enclosed within the housing receives a switch activity signal indicative of the position of the switch arm and responsively activates production of the audible message.

DETAILED DESCRIPTION OF THE INVENTION

Figure 1:
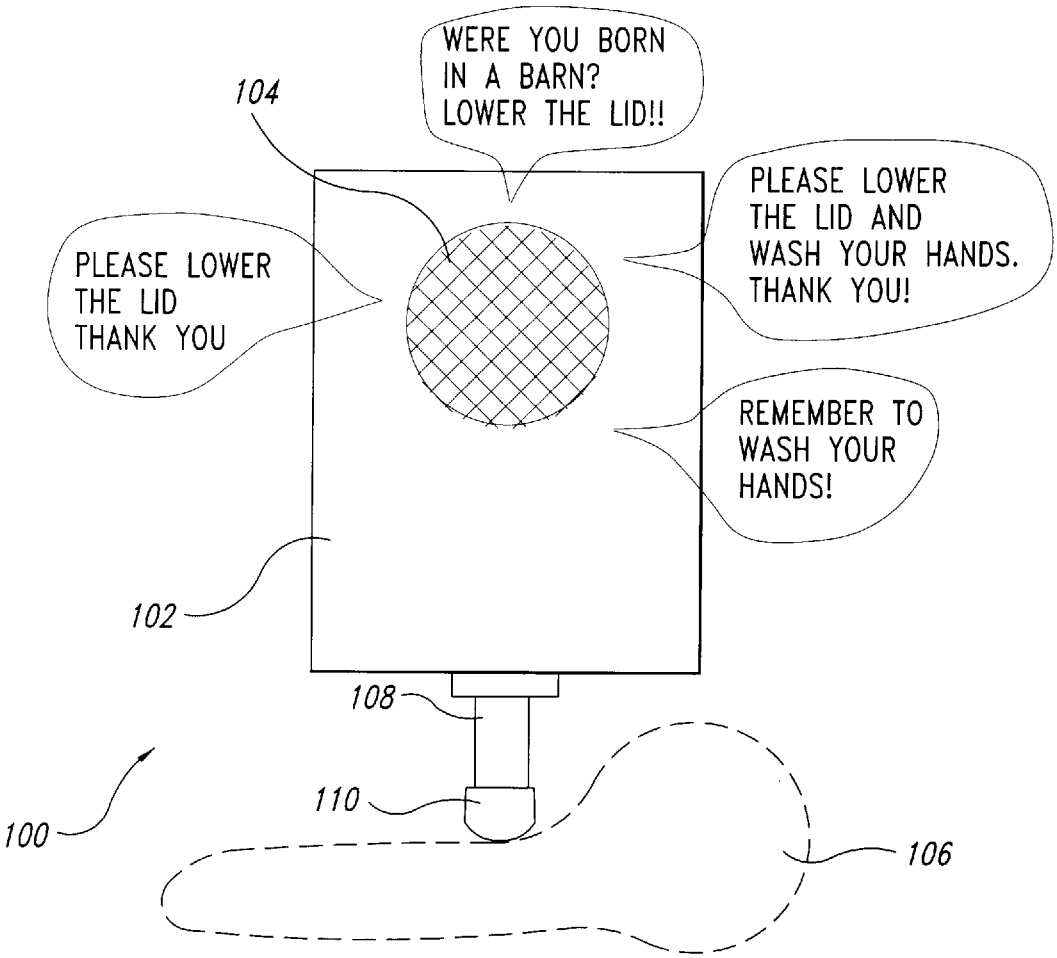
FIG. 1 is a front elevational view depicting an embodiment of a toilet instruction apparatus according to the present invention.

FIG. 1 depicts an embodiment of a toilet instruction apparatus 100, which includes a housing 102 enclosing electronic circuitry (not shown in FIG. 1) and an audio speaker 104 from which various positive reinforcing and/or humorous admonitions can be heard. The toilet instruction apparatus 100 is activated upon movement of a toilet flush handle 106. Upon depression of the toilet flush handle 106, a switch arm is mechanically actuated, such as springbiased trigger shaft 108 moving outward from the housing 102, to mechanically actuate an internal switch. The trigger shaft 108 is coupled with the toilet flush handle 106 by an adjustable trigger arm 110.

Figure 2:
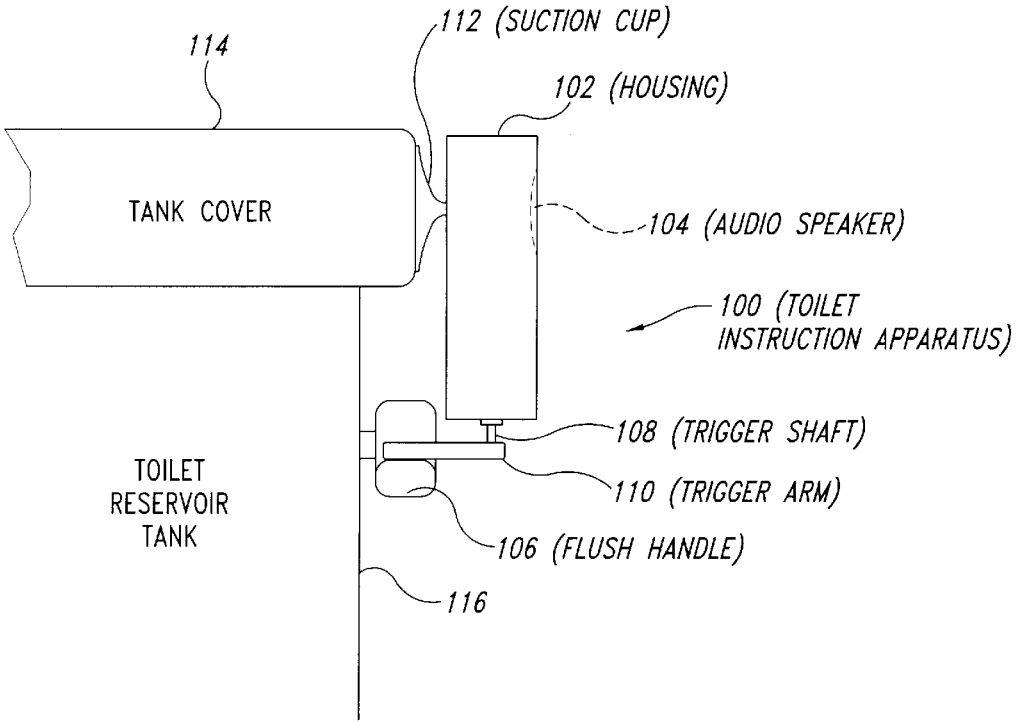
FIG. 2 is a side elevational view showing the toilet instruction apparatus of FIG. 1 affixed to a tank cover of a toilet reservoir tank.

As shown in FIG. 2, a suction cup 112 allows the housing 102 to be removably attached to a tank cover 114 of a toilet reservoir tank 116 of the type commonly found in household bathrooms. Those skilled in the art will appreciate that a wide variety of means can be employed to attach the toilet instruction apparatus 100 to a toilet. For example, and without limitation, a bracket can be used which is adapted to be inserted within the tank cover 114 and over a top edge of the reservoir tank 1 16. Alternatively, the housing 102 can be attached with an adhesive strip or other adhering surface. The toilet instruction apparatus 100 could be suitably modified for mounting within the interior of the toilet reservoir tank 116, with the speaker 104 or other audio output means positioned outside the reservoir tank. Indeed, the toilet instruction apparatus 100 could itself be integrated within the toilet itself.

FIG. 2 also shows the coupling of the trigger shaft 108 with the flush handle 106 by the adjustable trigger arm 110. Both the length of the trigger arm 110 and the vertical position of suction cup 112 relative to the housing 102 are adjustable, for purposes of adapting to different toilet geometries. Those skilled in the art will appreciate that a variety of mechanisms can be employed for coupling a switching mechanism with a toilet flushing mechanism. For example, and without limitation, the housing 102 can be attached to a side surface of the reservoir tank 116, with a switch arm adapted for coupling with an underside of the flush handle 106. Alternatively, the toilet instruction apparatus 100 could be adapted for positioning within the interior of the reservoir tank 1 16 and a switch arm provided which is coupled with a portion of the toilet flushing mechanism inside the reservoir tank.

The admonitory messages produced by the toilet instruction apparatus 100 (see FIG. 1 for examples) can be recorded prior to assembly of the unit. Alternatively, such messages could be recorded by the end user. The toilet instruction apparatus 100 can itself be readily adapted for recording messages by the end user, or a separately provided device could allow message recordation in message storage media which is installable within the apparatus. Upon hearing the messages in a familiar voice, a child or husband may be particularly likely to heed the advice.

Figure 3:
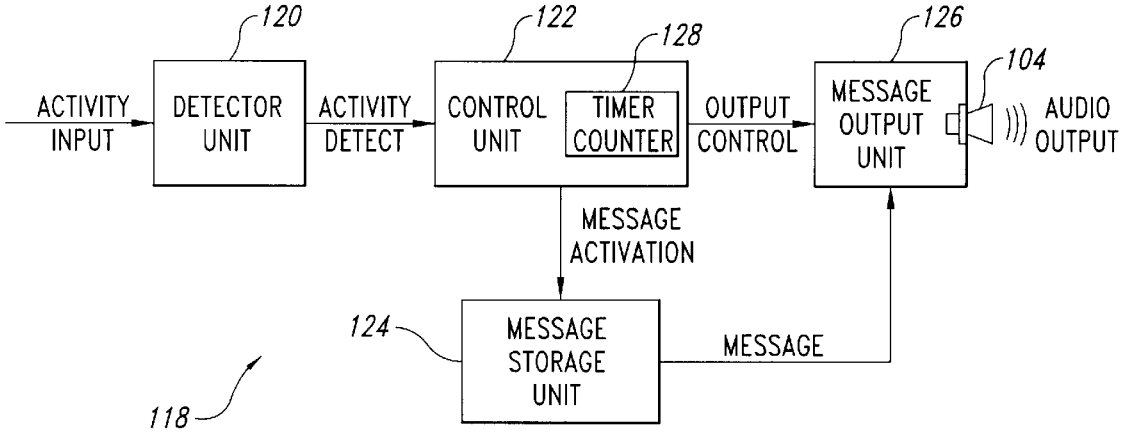
FIG. 3 is a functional block diagram depicting an embodiment of electronic circuitry contained within the toilet instruction apparatus of FIG. 1.

FIG. 3 is a functional block diagram which depicts an embodiment of electronic circuitry 118 included within the housing 102 of the toilet instruction apparatus 100. The circuitry 118 includes a detector unit 120, a control unit 122, a message storage unit 124, and a message output unit 126 which includes the audio speaker 104. The electronic circuitry is powered by a battery or other suitable source of electrical energy (not shown).

The detector unit 120 receives an activity input signal indicative of current toilet use activities. In the embodiment described in connection with FIGS. 1 and 2, the activity input signal is the mechanical actuation of an electronic switch via the coupling of the toilet flush handle 106 with the spring-biased trigger shaft 108 by the adjustable trigger arm 110. However, those skilled in the art will appreciate that the detector unit 120 may be adapted to detect and respond to a variety of activity input signals. For example, and without limitation, the detector unit 120 could include an optical, infrared, or other sensor adapted to detect the presence of a person using the toilet. Alternatively, the detector unit 120 could include a sensor or switching mechanism adapted to respond to the level of water contained within the toilet reservoir tank 116 of FIG. 2, or to respond to water activity within the toilet bowl or basin. Indeed, any of a variety of means for detecting toilet use or other activity in the vicinity of a toilet may be suitably adapted for use as the detector unit 120.

In response to detecting toilet use activity, the detector unit 120 produces an activity detect signal which is supplied to the control unit 122. The control unit 122 responsively produces a message activation signal and an output control signal. The message activation signal controls the timing and function of the message storage unit 124, which provides one of a plurality of message signals to the message output unit 126 in response to receipt of the message activation signal. The timing and function of the message output unit 126 is controlled by the output control signal received from the control unit. The message output unit 126 receives one or more of the plurality of message signals produced by the message storage unit 124 and produces a corresponding audio output signal via the audio speaker 104.

The control unit 122 may include a timer-counter unit 128 for monitoring the timing and frequency of certain activities and correspondingly selecting appropriate messages. For example, and without limitation, the counter function could monitor repeated flushing of the toilet (perhaps by an enthusiastic child), and a designated message could be activated which suggests that such repeated flushing should stop. Also, the timer function could be employed to first activate a message concerning the toilet seat/lid position, and after a selected time period has elapsed, a second message could be activated with instructions about handwashing. Further, the timer function could allow activation of a succession of encouraging messages to, for example, a child who has been sitting on the toilet seat for some time.

Those skilled in the art will appreciate that the control unit 122 can be any of a variety of suitably adapted circuits. For example, a specifically designed electronic hardware circuit can be employed. Alternatively, a local microcontroller executing software instructions can be used. Also, a remote controller, such as a personal computer system, could be suitably adapted to receive the activity detect signal and responsively produce the message activation and output control signals.

Those skilled in the art will appreciate that any of a number of devices can be suitably adapted for use as the message storage unit 124. For example, the message storage unit 124 can include magnetic media such as audio tapes or magnetic disks for storing messages. Alternatively, any of a variety of semiconductor memory devices or optically readable storage devices can be used. Like the control unit 122, the message storage unit 124 could be located remotely. This might be particularly advantageous for use with multiple toilets, in which case a single control unit 122 and message storage unit 124 are coupled with a plurality of detector units 120 and message output units 126 associated with the plurality of toilets. Such an implementation may be especially useful for public restrooms.

The messages stored in the message storage unit 124 can include any of a variety of messages suitable for reinforcing proper toilet use and hygiene. Such messages could include congratulatory remarks directed to young children or disparaging remarks intended for stubborn adults. In addition to information concerning proper toilet use and hygiene, the message storage unit 124 could include music and/or other sound effects to accompany the informational messages. As described above, the message storage unit 124 may include messages recorded prior to assembly of the toilet instruction apparatus 100, or may be adapted to allow repeated recording of a variety of messages and other audible information selected and recorded by the end user.

The toilet instruction apparatus 100 of the present invention provides a number of advantages over the prior art. The prior art includes devices which monitor the position of the toilet seat and/or lid and issue optical signals or loud and disturbing alarms. In contrast, the toilet instruction apparatus 100 in accordance with the present invention provides positive reinforcing and/or humorous admonitions enforcing proper toilet etiquette. In addition to addressing the age-old problem of the toilet seat and/or lid position, the present invention also provides instructions regarding subsequent personal hygiene steps, such as washing hands. If, for example, the detector unit 120 has a person-detect capability, the toilet instruction apparatus 100 could also issue audible instructions concerning flushing of the toilet.

The toilet instruction apparatus 100 depicted in FIGS. 1 and 2 is primarily intended for use in private homes. However, those skilled in the art will appreciate that the present invention can be readily adapted for a large-scale use, such as in public restrooms. As mentioned above, the control unit 122 and message storage unit 124 of FIG. 3 can be remotely located and control the operation of detector units 120 and message output units 126 associated with a large number of individual toilets. In such a case, the detector unit 120 could be triggered by the same sensor units commonly employed for automatically flushing toilets. Audio speakers 104 could be individually located within public restroom stalls, or a single audio speaker could be dedicated to the entire public restroom—in which case, the associated peer pressure of other occupants of the restroom may enhance the admonitory effect of the message.

Those skilled in the art will also appreciate that the control unit 122 could execute a series of operations to activate a plurality of corresponding messages. For example, a message output on an audio speaker associated with an individual toilet could address the issue of lowering the toilet seat and/or lid, while a separate audio speaker dedicated to the restroom generally or associated with a sink could provide instructions regarding handwashing. The second message regarding handwashing could simply be time-delayed relative to the first message, or could itself be activated in response to a signal produced by a separate sensor detecting, for example, a person's motion away from the toilet or near the sink. Indeed, any of a number of modifications may be made in an effort to optimize the effect of the various activated messages.

It will be appreciated that, although various embodiments of the invention have been described above for purposes of illustration, a number of modifications may be made without deviating from the spirit and scope of the invention. For example, those skilled in the art will appreciate that a number of mechanically actuated switching mechanisms may be substituted for the particular trigger shaft 108 and trigger arm 110 described above. Also, any number of important messages concerning personal hygiene may replace or augment those concerning toilet seat/lid positioning and handwashing. Additionally, optical signals and messages may advantageously augment the audible messages produced by the described toilet instruction apparatus 100. Further, one or more of the functional blocks described in connection with FIG. 3 could be integrated with another, thereby eliminating the need for one or more associated signals. Also, one or more of the functional blocks described in connection with FIG. 3 could be implemented using mechanical, acoustical, optical, magnetic, or other suitable devices. Indeed, numerous variations are well within the scope of this invention. Accordingly, the invention is not limited except as by the appended claims.

I claim:

1. An apparatus for instructing a person in use of a toilet and associated personal hygiene, comprising:

a detector unit operable to produce a detect signal responsive to toilet use activity;

a control unit coupled with the detector unit and operable to receive the detect signal and produce a control signal in response thereto;

a message storage unit coupled with the control unit and operable to store a plurality of recorded messages, the message storage unit operable to receive the control signal and produce a selected one of a plurality of message signals in response thereto; and a message output unit coupled with the message storage unit and operable to receive the selected message signal and to produce a corresponding audible instruction concerning the use of the toilet and associated personal hygiene.

2. The apparatus of claim 1 wherein each of the detect signal, the control signal, and the message signals is an electric signal.

3. The apparatus of claim 1 wherein the detector unit is adapted to receive a mechanically actuated switch signal indicative of toilet flushing activity and to produce the detect signal in response thereto.

4. The apparatus of claim 1, further comprising a housing adapted for removable attachment to the toilet and substantially enclosing the detector unit, the control unit, the message storage unit, and the message output unit.

5. An apparatus for instructing a person in use of a toilet and associated personal hygiene, comprising:

a housing adapted for attaching to the toilet;

a switch arm extending from the housing and adapted for coupling with a flushing mechanism of the toilet;

an audio speaker partially enclosed within the housing; and electronic circuitry enclosed within the housing and operable to store a plurality of recorded messages, each containing instructions for suggested activities following flushing of the toilet, the electronic circuitry further operable to receive a switch activity signal indicative of the position of the switch arm and to responsively select one of the recorded messages, the electronic circuitry providing electric signals corresponding to the selected message to the audio speaker to produce corresponding audible instructions.

6. The apparatus of claim 5, further comprising a suction cup for attaching the housing to the toilet.

7. The apparatus of claim 5 wherein the switch arm is adapted for coupling with a flush handle of the toilet.

8. A method of instructing a person in use of a toilet and associated personal hygiene, comprising the steps of:

storing a plurality of recorded messages containing instructions for suggested activities in the use of the toilet and associated personal hygiene;

monitoring toilet use to detect toilet activity;

in response to detecting the toilet activity, selecting a first of the recorded messages; and providing the selected first of the recorded messages to the person.

9. The method of claim 8, further comprising the steps of:

selecting a second of the recorded messages;

waiting for a time interval following detection of the toilet activity; and after the time interval has elapsed, providing the selected second of the recorded messages to the person.

10. The method of claim 9 wherein waiting for a time interval following detection of the toilet activity includes the step of waiting for a time interval determined by detecting the person away from the toilet.

11. The method of claim 8 wherein the step of monitoring toilet use to detect toilet activity includes the step of monitoring toilet use to detect flushing of the toilet.

12. The method of claim 8 wherein the step of providing the selected first of the recorded messages to the person includes the step of producing audible words instructing the person of a next suggested activity.

13. The method of claim 12 wherein the step of producing audible words instructing the person of a next suggested activity includes the step of providing verbal instructions to the person regarding handwashing.

14. The method of claim 12 wherein the step of producing audible words instructing the person of a next suggested activity includes the step of providing verbal instructions to the person regarding positioning of the toilet seat or lid.

* * * * *